United States Patent [19]

Inoue

[11] 4,081,114

[45] Mar. 28, 1978

[54] MAGNETIC SUPPORTER ASSEMBLY

[75] Inventor: Mitio Inoue, Tokyo, Japan

[73] Assignee: TDK Electronics Company, Limited, Tokyo, Japan

[21] Appl. No.: 618,845

[22] Filed: Oct. 2, 1975

[30] Foreign Application Priority Data

Oct. 3, 1974 Japan ..... 49-119469[U]

[51] Int. Cl.[2] ..... A45F 5/00

[52] U.S. Cl. ..... 224/5 C; 248/206 A

[58] Field of Search ..... 273/32 A; 224/5 C, 28 F; 335/285, 306, 303, 285, 302; 248/206 A; 308/10

[56] References Cited

U.S. PATENT DOCUMENTS

| | | | |
|---|---|---|---|
| 2,812,203 | 11/1957 | Scholten | 335/285 X |
| 3,207,960 | 9/1965 | MacDougal | 335/306 X |
| 3,277,681 | 10/1966 | Bey | 335/285 X |
| 3,815,066 | 6/1974 | Vinal | 335/306 |
| 3,923,215 | 12/1975 | Suzuki | 224/5 C |
| 3,938,805 | 2/1976 | Sakuma | 273/32 A |

*Primary Examiner*—George Harris

*Attorney, Agent, or Firm*—Oblon, Fisher, Spivak, McClelland & Maier

[57] ABSTRACT

A magnetic supporter assembly supports a mark piece in a ring permanent magnet which is magnetized to form a multipolar magnet.

1 Claim, 11 Drawing Figures

MAGNETIC SUPPORTER ASSEMBLY

BACKGROUND OF THE INVENTION

1. Field of the Invention

The present invention relates to a magnetic supporter for supporting a removable mark piece such as a golf ball position mark or a mark for accessories.

2. Description of the Prior Art

A golf ball position mark is used for showing the position of a golf ball on a green and is usually held on a shoe, a band or a necktie, etc. In a conventional mark, a planar magnetic mark piece is attracted to a planar permanent magnet disposed on one surface in a concave nonmagnetic base.

Various shapes of the permanent magnet have been proposed to permit easy removal of the mark piece or a projection may be fixed on the mark piece. However, there are disadvantages in that the structures of conventional assembly are complicated or the mark piece can only be removed by exerting undue pressure on the projection.

SUMMARY OF THE INVENTION

It is an object of the present invention to provide a magnetic supporter assembly having a simple structure wherein a mark piece can be easily inserted and removed.

Another object of the present invention is to provide a magnetic supporter assembly which comprises a magnetic mark piece attracted to a ring permanent magnet which is magnetized with an electromagnetic coil to form a multipolar magnet.

The foregoing and other objects are attained in accordance with one aspect of the present invention, through the provision of a magnetic supporter assembly comprising a ring permanent magnet magnetized to form a multipolar magnet and a magnetic mark piece magnetically radially held therein.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF A PREFERRED EMBODIMENT

Figure 1:
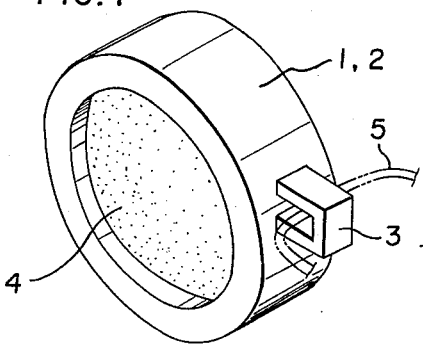
FIG. 1 is a schematic view of a magnetic supporter assembly according to the invention.
Figure 2:
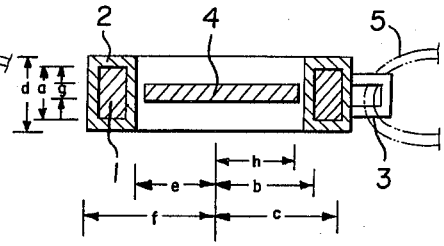
FIG. 2 is a sectional view of the magnetic supporter assembly of the invention.

Referring now to the drawings, wherein like reference numerals designate identical or corresponding parts throughout the several views, and more particularly to FIGS. 1 and 2 thereof, FIGS. 1 and 2 are a schematic view and a sectional view of one embodiment of the magnetic supporter assembly according to the invention.

A ring permanent magnet 1 which is magnetized to form a multipolar magnet on the inner surface is molded with a protective material 2 such as synthetic resin. A supporting element 3 for retaining a string 5 is formed on the outer surface.

A magnetic mark piece 4 is attracted to the ring permanent magnet 1 and has a size smaller than the inner diameter of the protective material molded on the permanent magnet 1.

A plurality of magnetic poles having substantially the same intensity (2–10, preferably 2–4 pairs of magnetic poles) are disposed with equal spaces on the inner surface of the ring permanent magnet 1 so that the mark piece 4 is attractively held in the radial direction in the ring permanent magnet. Accordingly, the mark piece 4 is preceisely held in the ring permanent magnet 1 even though there is a gap between the mark piece 4 and the ring permanent magnet 1 and the mark piece 4 is not easily undesirably removed from the ring permanent magnet 1.

The mark piece 4 is removed from the ring permanent magnet 1 by pushing the mark piece with a finger through the opening of the ring permanent magnet 1. Since the direction of attraction of the mark piece 4 is radial, the pressure necessary for removing the mark piece can be quite small.

Figure 3:
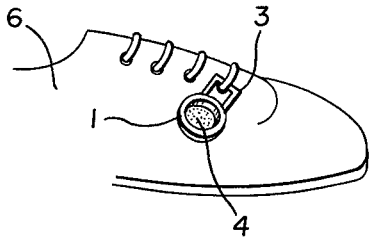
FIGS. 3–9 illustrate conditions under which the magnetic supporter assembly of the invention may be used.
Figure 4:
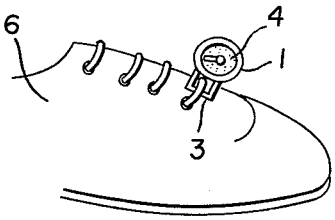

FIGS. 3–9 show conditions of use of the magnetic supporter assembly according to the invention FIGS. 3 and 4 show connection to a shoe 6 with a shoestring with the magnetic supporter assembly being held in a vertical or a horizontal direction.

Figure 5:
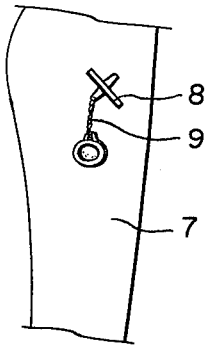

FIG. 5 shows a connection to a chain 9 with a clip which may be inserted in a pocket 8 of trousers 7.

Figure 6:
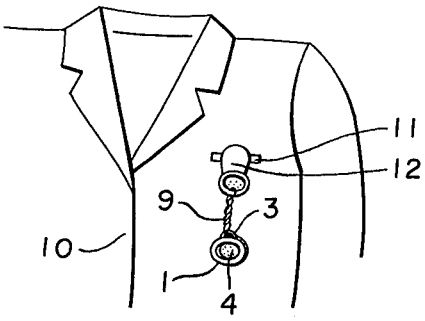

FIG. 6 shows a connection to a chain 9 with a wide clip 12 which is inserted in a pocket 11 of a jacket 10.

Figure 7:
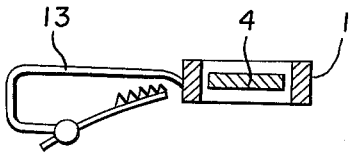

FIG. 7 shows a connection to a necktie holder 13.

Figure 8:
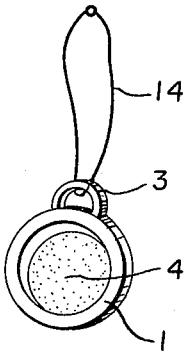

FIG. 8 shows a connection to a string 14 so as to hang from the neck as a pendant.

Figure 9:
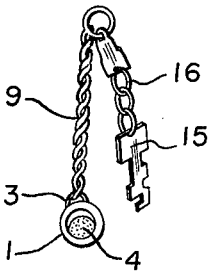

FIG. 9 shows a connection to a keyholder having a key 15 and a chain 16.

In addition, it is believed clear that the magnetic supporter assembly according to the invention can be held in various other conditions as well as the above-mentioned conditions and can be used as a golf ball position mark or a mark for accessories.

Figure 10:
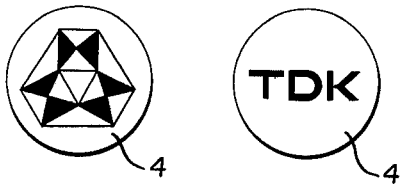
FIG. 10 is a plane view of a mark piece.

FIG. 10 is a plane view of the mark pieces 4 having a picture or a figure. These decorative mark pieces 4 can be advantageously used with the necktie holder or the pendant shown in FIGS. 7 and 8.

Figure 11:
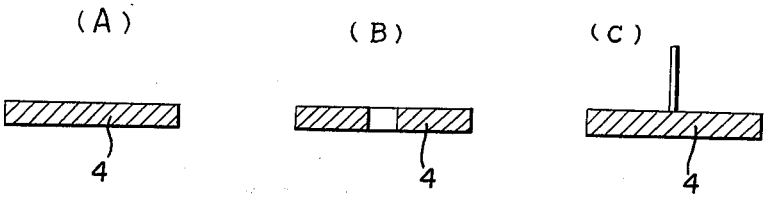
FIG. 11 is a sectional view of a mark piece.

FIGS. 11A, 11B and 11C show sectional views of the mark pieces 4. FIG. 11A shows a disk, FIG. 11B shows a disk having a central hole and FIG. 11C shows a disk having a projection.

The magnetic supporter assembly of the invention has a simple structure and the mark piece can be easily inserted and removed as desired and can be used as a golf ball position mark or a display mark for accessories. Accordingly, the practical value of the invention is great.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A magnetic supporter assembly comprising:

a ring permanent magnet magnetized to form a multipolar magnet having a height *a*, an inner radius *b* and an outer radius *c*, a protective material completely enveloping the ring permanent magnet to form a hollow ring of height *d*, inner radius *e* and outer radius *f*, inner radius *b* of the ring permanent magnet being larger than inner radius *e* of the protective material, outer radius *c* of the ring permanent magnet being less than outer radius *f* of the protective material and height *a* of the ring permanent magnet being less than height *d* of the protective material, a supporting element having an opening therein affixed to the outer periphery of the protective material, a magnetic mark piece in the shape of a right cylinder having a height *g* and a radius *h* adapted to be suspended and magnetically radially held in the space within the ring permanent magnet, the radius *h* of the magnetic mark piece being less than the inner radius *e* of the protective material to form a gap therebetween, the height *g* of the magnetic mark piece being less than the height *a* of the ring permanent magnet.

* * * * *